US009304414B2

(12) United States Patent
Miura et al.

(10) Patent No.: US 9,304,414 B2
(45) Date of Patent: Apr. 5, 2016

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Daisuke Miura, Tokyo (JP); Daisuke Tanaka, Yokohama (JP); Kazumichi Sugiyama, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 14/160,445

(22) Filed: Jan. 21, 2014

(65) Prior Publication Data

US 2014/0212807 A1 Jul. 31, 2014

(30) Foreign Application Priority Data

Jan. 28, 2013 (JP) ..... 2013-013511
Jan. 14, 2014 (JP) ..... 2014-004382

(51) Int. Cl.
*G03G 5/05* (2006.01)
*G03G 5/047* (2006.01)

(52) U.S. Cl.
CPC ..... *G03G 5/047* (2013.01); *G03G 5/056* (2013.01); *G03G 5/0514* (2013.01); *G03G 5/0517* (2013.01); *G03G 5/0525* (2013.01); *G03G 5/0564* (2013.01)

(58) Field of Classification Search
CPC .. G03G 5/0525; G03G 5/0564; G03G 5/0614
See application file for complete search history.

(56) References Cited

U.S. PATENT DOCUMENTS

| | | | | |
|---|---|---|---|---|
| 8,632,935 | B2 | 1/2014 | Sugiyama et al. | |
| 2005/0112278 | A1* | 5/2005 | Obata et al. | 427/231 |
| 2006/0127796 | A1 | 6/2006 | Obata et al. | |
| 2010/0067953 | A1* | 3/2010 | Nohsho et al. | 399/171 |
| 2014/0205946 | A1 | 7/2014 | Sugiyama et al. | |

FOREIGN PATENT DOCUMENTS

| | | | |
|---|---|---|---|
| EP | 1 130 474 | A2 | 9/2001 |
| JP | 5-66577 | A | 3/1993 |
| JP | 2006-138932 | A | 6/2006 |

(Continued)

OTHER PUBLICATIONS

Occupation Safety and Health Guideline for Cyclohexanone (OSHG; US Department of Health and Human Services, 1988).*

(Continued)

*Primary Examiner* — Peter Vajda
(74) *Attorney, Agent, or Firm* — Fitzpatrick, Cella, Harper and Scinto

(57) ABSTRACT

A method for producing an electrophotographic photosensitive member having a charge transporting layer, the charge transporting layer being a surface layer, the method including drying a coat of a charge-transporting-layer coating liquid to form the charge transporting layer, wherein the charge-transporting-layer coating liquid contains components (α), (β), (γ) and (δ), and when the solubility of the component (α) in 100 g of the component (γ) is defined as X(g) and the solubility of the component (α) in 100 g of the component (δ) is defined as Y(g), solubility X and solubility Y satisfy a relationship of X>Y.

8 Claims, 1 Drawing Sheet

(56) References Cited

FOREIGN PATENT DOCUMENTS

| | | | |
|---|---|---|---|
| JP | 2007-47655 | A | 2/2007 |
| JP | 2007-72277 | A | 3/2007 |
| JP | 2007-79555 | A | 3/2007 |
| WO | 2013/094497 | A1 | 6/2013 |

OTHER PUBLICATIONS

Material Safety Data Sheet for Toluene (MSDS; BDH, Dec. 21, 2005).*

European Search Report dated May 2, 2014 in European Application No. 14152589.9.

* cited by examiner

METHOD FOR PRODUCING ELECTROPHOTOGRAPHIC PHOTOSENSITIVE MEMBER

BACKGROUND OF THE INVENTION

1. Field of the Invention

The present invention relates to a method for producing an electrophotographic photosensitive member.

2. Description of the Related Art

As an electrophotographic photosensitive member to be mounted to an electrophotographic apparatus, an electrophotographic photosensitive member using organic photoconductive substances (organic charge generating substance and organic charge transporting substance) is used in many cases. In particular, an electrophotographic photosensitive member is often used, which has a laminated type photosensitive layer in which a charge generating layer containing a charge generating substance and a charge transporting layer containing a charge transporting substance are laminated in this order and the charge transporting layer is a surface layer.

As an electrophotographic apparatus repeatedly forms an image, an electrophotographic photosensitive member is demanded for having potential stability in order to provide a stable image quality even if being repeatedly used. In addition, when an electrophotographic photosensitive member is repeatedly used, the surface thereof is directly subjected to electrical external forces and mechanical external forces such as charging, exposing, developing, transferring and cleaning, and therefore an electrophotographic photosensitive member is also demanded for having durability (wear resistance) to such forces.

In regard to such a problem that an electrophotographic photosensitive member simultaneously satisfies wear resistance and potential stability, a method including allowing a charge transporting layer to have the concentration gradient of a charge transporting substance in the thickness direction thereof has been previously proposed. As the method including allowing a charge transporting layer to have the concentration gradient, Japanese Patent Application Laid-Open No. H05-66577 has proposed a method including laminating (applying many times) charge-transporting-layer coating liquids having a different charge transporting substance concentration. Japanese Patent Application Laid-Open No. 2006-138932 has proposed a method including laminating charge-transporting-layer coating liquids having a different charge transporting substance concentration and then annealing the resultant at a temperature near the glass transition temperature of a binder resin, or holding the resultant in a saturated vapor of a solvent.

However, in the method described in Japanese Patent Application Laid-Open No. H05-66577, since two charge transporting layers are required to be laminated, the number of steps increase as compared with the case where one charge transporting layer is provided, to thereby tend to increase the production cost. Furthermore, since the charge transporting substance is contained also in the vicinity of the surface of the charge transporting layer being an upper layer, wear resistance is not sufficiently achieved in some cases. In the method described in Japanese Patent Application Laid-Open No. 2006-138932, since a step of laminating charge transporting layers is required and an annealing step or a step of holding a coat in a solvent vapor is also added, the production process is complicated to thereby tend to increase the production cost.

SUMMARY OF THE INVENTION

An object of the present invention is to provide a method for producing an electrophotographic photosensitive member in which a charge transporting layer is a surface layer, wherein the electrophotographic photosensitive member simultaneously satisfies a high wear resistance and a high potential stability after repeated use. In addition, another object of the present invention is to provide a method for simply producing an electrophotographic photosensitive member having a charge transporting layer having the concentration gradient of a charge transporting substance.

The objects are achieved by the following present invention.

The present invention relates to a method for producing an electrophotographic photosensitive member having a support, a charge generating layer formed on the support, and a charge transporting layer formed on the charge generating layer, the method including: forming a coat for the charge transporting layer using a charge-transporting-layer coating liquid, and drying the coat to form the charge transporting layer, wherein the charge transporting layer is a surface layer, the charge-transporting-layer coating liquid contains: (α) a charge transporting substance, (β) at least one resin selected from the group consisting of a polycarbonate resin having a structural unit represented by the following formula (1A), and a polyester resin having a structural unit represented by the following formula (1B), (γ) an aromatic hydrocarbon solvent, and (δ) a compound having a boiling point under 1 atmosphere higher than that of the (γ); the charge-transporting-layer coating liquid is free of any polyester resins having a siloxane structure at the end thereof and any polycarbonate resins having a siloxane structure at the end thereof; and the (α), the (γ) and the (δ) satisfy the following expression.

$$X(g)>Y(g)$$

In the expression, X(g) represents the solubility of the (α) in 100 g of the (γ) in an environment at 23° C. under 1 atmosphere, and Y(g) represents the solubility of the (α) in 100 g of the (δ) in an environment at 23° C. under 1 atmosphere.

(1A)

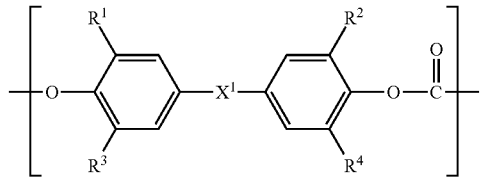

(1B)

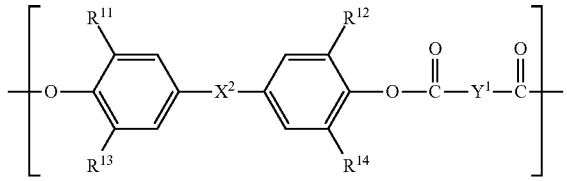

In the formula (1A), $R^1$ to $R^4$ each independently represent a hydrogen atom, a methyl group or a phenyl group, and $X^1$ represents a single bond, an oxygen atom, a cyclohexylidene group or a bivalent group represented by the following formula (A).

In the formula (1B), $R^{11}$ to $R^{14}$ each independently represent a hydrogen atom, a methyl group or a phenyl group, $X^2$ represents a single bond, an oxygen atom, a cyclohexylidene group or a bivalent group represented by the following formula (A), and $Y^1$ represents a meta-phenylene group, a para-phenylene group, a cyclohexylene group or a bivalent group represented by the following formula (B).

(A)

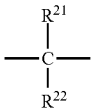

(B)

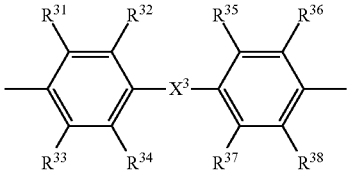

In the formula (A), $R^{21}$ and $R^{22}$ each independently represent a hydrogen atom, a methyl group, an ethyl group or a phenyl group.

In the formula (B), $R^{31}$ to $R^{38}$ each independently represent a hydrogen atom, a methyl group or a phenyl group, and $X^3$ represents a single bond, an oxygen atom, a sulfur atom or a methylene group.

As described above, the present invention can provide a method for producing an electrophotographic photosensitive member that simultaneously satisfies a high wear resistance and a high potential stability during repeated use. In addition, the present invention can provide a method for simply producing an electrophotographic photosensitive member having a charge transporting layer having the concentration gradient of a charge transporting substance.

Further features of the present invention will become apparent from the following description of exemplary embodiments with reference to the attached drawings.

DESCRIPTION OF THE EMBODIMENTS

Figure 1:
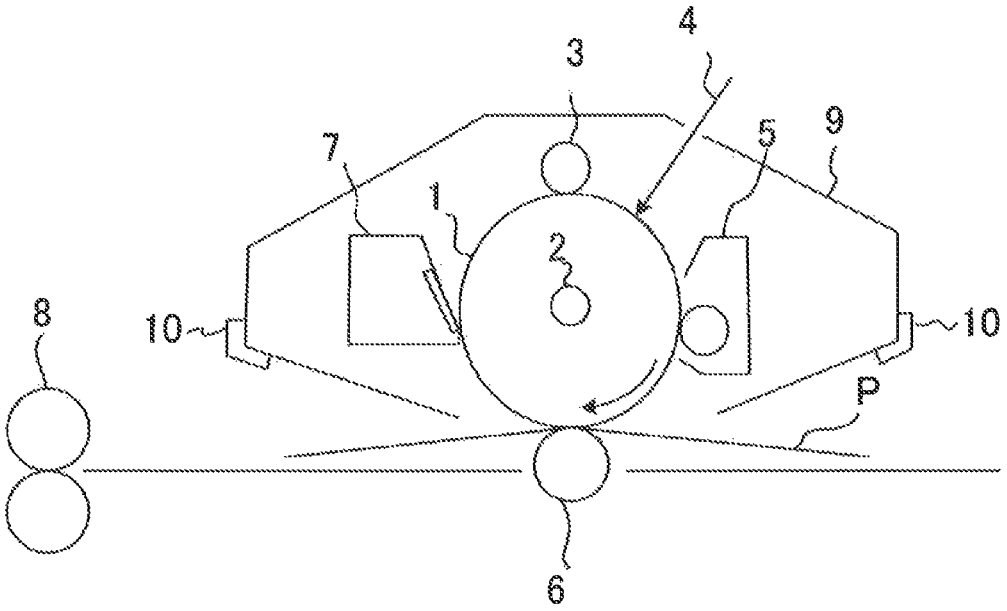
FIG. 1 is a view illustrating one example of a schematic configuration of an electrophotographic apparatus provided with a process cartridge having an electrophotographic photosensitive member.

Preferred embodiments of the present invention will now be described in detail in accordance with the accompanying drawings.

The method for producing an electrophotographic photosensitive member of the present invention is a method for producing an electrophotographic photosensitive member having a support, a charge generating layer and a charge transporting layer, the charge transporting layer being a surface layer. The method includes forming a coat using a charge-transporting-layer coating liquid and drying the coat to form the charge transporting layer (charge transporting layer-forming step). Then, the charge-transporting-layer coating liquid contains the following (α), (β), (γ) and (δ). Then, the charge-transporting-layer coating liquid is free of any polyester resins having a siloxane structure at the end thereof and any polycarbonate resins having a siloxane structure at the end thereof, and the (α), (γ) and (δ) satisfy the following expression.

$$X(g)>Y(g)$$

In the expression, X(g) represents the solubility of the (α) in 100 g of the (γ) in an environment at 23° C. under 1 atmosphere, and Y(g) represents the solubility of the (α) in 100 g of the (δ) in an environment at 23° C. under 1 atmosphere.

X(g) and Y(g) are also referred to as solubility X and solubility Y, respectively.

The present inventors have found that the charge transporting layer-forming step is used to form the charge transporting layer, thereby changing the ratio of a charge transporting substance to a binder resin in the thickness direction to provide the concentration gradient of the charge transporting substance in the thickness direction.

In general, the charge transporting substance serves to transport charge, and the binder resin contributes to wear resistance on the surface of the electrophotographic photosensitive member. The charge transporting layer formed in the charge transporting layer-forming step has a graded structure so that the mass ratio of the charge transporting substance to the binder resin is increased in the thickness direction from the surface of the charge transporting layer toward the support (charge generating layer). Therefore, the mass proportion of the binder resin is increased in the vicinity of the surface of the charge transporting layer, thereby enhancing wear resistance of the electrophotographic photosensitive member (charge transporting layer). Then, the mass proportion of the charge transporting substance is increased on the surface of the charge transporting layer nearer the support (the vicinity of the interface with the charge generating layer), and charge transporting property is thus effectively exhibited. The present inventors consider that the electrophotographic photosensitive member can thus simultaneously satisfy wear resistance and potential stability.

Furthermore, the present inventors presume the reason why the charge transporting layer has the concentration gradient of the charge transporting substance in the thickness direction thereof as follows.

In the step of drying the coat of the charge-transporting-layer coating liquid, heat from the support is conducted from the coat nearer the support (the interface with the charge generating layer), and thus a solvent of the coat in the vicinity of the support vaporizes. It is considered that since the boiling point of the (γ) (aromatic hydrocarbon solvent) is lower than the boiling point of the (δ), the (γ) preferentially vaporizes by heating in the coat nearer the support. In the present invention, solubility X of the charge transporting substance (the (α)) in the (γ) is higher than solubility Y of the charge transporting substance (the (α)) in the (δ). Accordingly, the (γ) preferentially vaporizes by heating as compared with the (δ), and thus the amount of the (γ) in the coat is reduced as compared with the amount of the (δ) in the coat nearer the support. As a result, it is considered that the charge transporting substance that cannot be completely dissolved is precipitated in the coat nearer the support.

As the drying of the coat further progresses, the charge transporting layer is formed while the solid content concentration of the coat being increased over time. In addition, the content rate of the (γ) in the coat on the process of drying is gradually lowered. As a result, as the content rate of the (γ) is reduced over time, the charge transporting substance is precipitated. The present inventors consider that the continuous change in the ratio of the solvent (γ) to the solvent (δ) and the difference between the solubility of the charge transporting substance in the solvent (γ) and the solubility thereof in the solvent (δ) are utilized to thereby enable the concentration of the charge transporting substance in the charge transporting layer to have a gradient. Herein, the difference between the solubility of the (β), namely, the polycarbonate resin and/or polyester resin in the (γ) and the solubility thereof in the (δ) is relatively lower than the difference between the solubility of the charge transporting substance in the (γ) and the solubility thereof in the (δ) as described above. Therefore, it is considered that the charge transporting layer having the concentration gradient of the charge transporting substance in the thickness direction thereof is formed by the difference between the solubility of the charge transporting substance in the (γ) and the solubility thereof in the (δ).

(Regarding (γ))

The (γ) is an aromatic hydrocarbon solvent. In the present invention, the aromatic hydrocarbon solvent is one having aromaticity and including only carbon atoms and hydrogen atoms, and for example, is a solvent (compound) having no halogen atom. More preferably, the aromatic hydrocarbon solvent is at least one selected from the group consisting of toluene, xylene, ethylbenzene and mesitylene.

(Regarding (δ))

The (δ) is a compound having a higher boiling point under 1 atmosphere than the (γ). With respect to the examples of the (γ), xylene has a boiling point of 138 to 144° C., toluene has a boiling point of 110.6° C., ethylbenzene has a boiling point of 136° C., and mesitylene has a boiling point of 165° C. The (δ) is selected depending on the type (boiling point) of the (γ) used concurrently. Since it is considered that if one having a lower boiling point than the (γ) is selected as the (δ), the (γ) hardly vaporizes preferentially, it is considered that the effect of simultaneously satisfying a high wear resistance and a high potential stability during repeated use is not sufficiently achieved.

The compound having a higher boiling point under 1 atmosphere than that of the (γ) means a compound having a higher boiling point than that of the aromatic hydrocarbon solvent. For example, when the (γ) contains only toluene, the compound is a compound having a higher boiling point under 1 atmosphere than toluene, and when the (γ) contains only xylene, the compound is a compound having a higher boiling point under 1 atmosphere than xylene. When the (γ) is a mixed solvent, the compound is a compound having a higher boiling point than a compound whose boiling point is the highest in the mixed solvent. For example, when xylene and toluene are used, a compound having a higher boiling point under 1 atmosphere than xylene corresponds to the (δ).

When the solubility of the charge transporting substance in 100 g of the (γ) and the solubility of the charge transporting substance in 100 g of the (δ) in an environment at 23° C. under 1 atmosphere are defined as X(g) and Y(g), respectively, solubility X and solubility Y satisfy a relationship of X>Y.

In a combination not satisfying the relationship of X>Y, it is considered that the charge transporting substance is prevented from being distributed in the coat nearer the support and the effect of simultaneously satisfying a high wear resistance and a high potential stability during repeated use is not sufficiently achieved.

Specific examples of a solvent as a candidate of the (δ) include dibutyl ether (boiling point: 142° C.), di-n-hexyl ether (boiling point: 227° C.), butyl phenyl ether (boiling point: 210.2° C.), anisole (boiling point: 154° C.), phenetole (boiling point: 172° C.), 4-methylanisole (boiling point: 174° C.), ethyl benzyl ether (boiling point: 186° C.), diphenyl ether (boiling point: 259° C.), dibenzyl ether (boiling point: 297° C.), 1,4-dimethoxybenzene (boiling point: 213° C.), cineol (boiling point: 176° C.), 1,2-dibutoxyethane (boiling point: 203° C.), diethylene glycol dimethyl ether (boiling point: 162° C.), diethylene glycol ethyl methyl ether (boiling point: 179° C.), ethylene glycol diethyl ether (boiling point: 189° C.), triethylene glycol dimethyl ether (boiling point: 216° C.), dipropylene glycol dimethyl ether (boiling point: 175° C.), diethylene glycol diethyl ether (boiling point: 188° C.), diethylene glycol dibutyl ether (boiling point: 256° C.), 1-hexanol (boiling point: 158° C.), 1-heptanol (boiling point: 176° C.), cyclohexanol (boiling point: 161° C.), benzyl alcohol (boiling point: 205° C.), ethylene glycol (boiling point: 197.3° C.), 1,4-butanediol (boiling point: 230° C.), 1,5-pentanediol (boiling point: 242° C.), diethylene glycol (boiling point: 244.3° C.), 2-heptanone (boiling point: 151.5° C.), 4-heptanone (boiling point: 143.7° C.), acetylacetone (boiling point: 140.4° C.), diisobutyl ketone (boiling point: 163° C.), acetonylacetone (boiling point: 191° C.), phorone (boiling point: 198° C.), acetophenone (boiling point: 202° C.), isophorone (boiling point: 215.3° C.), cyclohexanone (boiling point: 155.6° C.), methylcyclohexanone (boiling point: 169° C.), benzyl acetate (boiling point: 212° C.), pentyl acetate (boiling point: 149.2° C.), isopentyl acetate (boiling point: 142.1° C.), 3-methoxybutyl acetate (boiling point: 172° C.), 2-ethylbutyl acetate (boiling point: 160° C.), 2-ethylhexyl acetate (boiling point: 198.6° C.), cyclohexyl acetate (boiling point: 172° C.), benzyl acetate (boiling point: 215.5° C.), methyl benzoate (boiling point: 199.6° C.), ethyl benzoate (boiling point: 212° C.), butyl propionate (boiling point: 146.8° C.), isopentyl propionate (boiling point: 160.7° C.), butyl butyrate (boiling point: 166.6° C.), isopentyl butyrate (boiling point: 184.8° C.), diethyl oxalate (boiling point: 188.5° C.), diethyl malonate (boiling point: 199.3° C.), dimethyl phthalate (boiling point: 283° C.), methyl salicylate (boiling point: 222° C.), ethyl 3-ethoxypropionate (boiling point: 166° C.), ethylene glycol monomethyl ether acetate (boiling point: 145° C.), ethylene glycol monoethyl ether acetate (boiling point: 156.3° C.), propylene glycol monomethyl ether acetate (boiling point: 146° C.), ethylene glycol monobutyl ether acetate (boiling point: 192° C.), ethylene glycol monohexyl ether acetate (boiling point: 208.3° C.), diethylene glycol monoethyl ether acetate (boiling point: 217.4° C.), γ-butyrolactone (boiling point: 204° C.), ethylene carbonate (boiling point: 260.7° C.), propylene carbonate (boiling point: 240° C.), cumene (boiling point: 152.4° C.), tetralin (boiling point: 207.5° C.), butylbenzene (boiling point: 183.3° C.), t-butylbenzene (boiling point: 169° C.), p-cymene (boiling point: 177.1° C.), cyclohexylbenzene (boiling point: 238.9° C.), o-diethylbenzene (boiling point: 183.5° C.), pentylbenzene (boiling point: 205° C.), dodecylbenzene (boiling point: 288° C.), nonane (boiling point: 150.8° C.), decane (boiling point: 174.2° C.), N-methylpyrrolidone (boiling point: 202° C.), nitrobenzene (boiling point: 210.9° C.) and sulfolane (boiling point: 285° C.). For example, the (δ) is selected from among these solvents in consideration of levels of the boiling point of the (δ) and the boiling point of the (γ) as well as the relationship of X>Y.

In particular, the solvent as a candidate of the (δ) can be hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, pyrrolidone, N-methylpyrrolidone, methyl benzoate, ethyl benzoate, benzyl acetate, ethyl 3-ethoxypropionate, acetophenone, methyl salicylate, dimethyl phthalate and sulfolane.

The content of the (γ) can be higher than the content of the (δ) in the charge-transporting-layer coating liquid because wear resistance and potential stability during repeated use can be simultaneously satisfied at a higher level.

(Regarding (α) Charge Transporting Substance)

Examples of the charge transporting substance include a triarylamine compound, a hydrazone compound, a styryl compound, a stilbene compound, a pyrazoline compound, an oxazole compound, a thiazole compound, a triarylmethane compound and an enamine compound. For example, the charge transporting substance is selected from among the compounds in consideration of the relationship of X>Y. The charge transporting substance for use in the present invention may be made of only one of the compounds, or may be made of two or more of the compounds. The compound that can be used as the charge transporting substance is a compound represented by the following formula (2), a compound represented by the following formula (3) and a compound represented by the following formula (4).

(2)

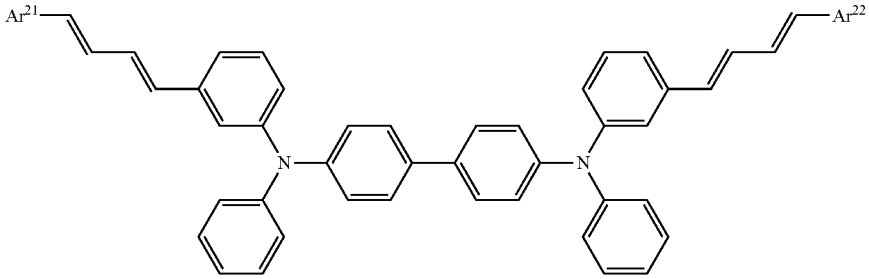

(3)

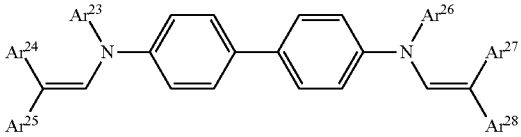

(4)

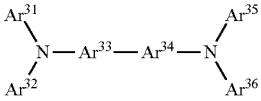

In the formula (2), $Ar^{21}$ and $Ar^{22}$ each independently represent a phenyl group or a phenyl group substituted with a methyl group. In the formula (3), $Ar^{23}$ to $Ar^{28}$ each independently represent a phenyl group or a phenyl group substituted with a methyl group. In the formula (4), $Ar^{31}$, $Ar^{32}$, $Ar^{35}$ and $Ar^{36}$ each independently represent a phenyl group or a phenyl group substituted with a methyl group, and $Ar^{33}$ and $Ar^{34}$ each independently represent a phenylene group or a phenylene group substituted with a methyl group.

Specific examples of the compound represented by the formula (2), the compound represented by the formula (3) and the compound represented by the formula (4) are shown below.

(CTM-1)

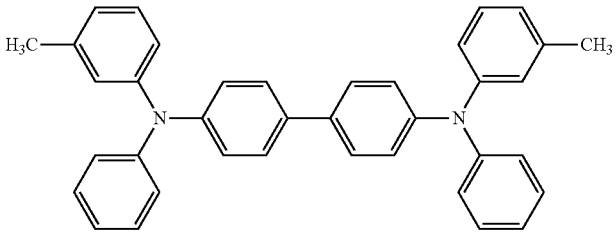

(CTM-2)

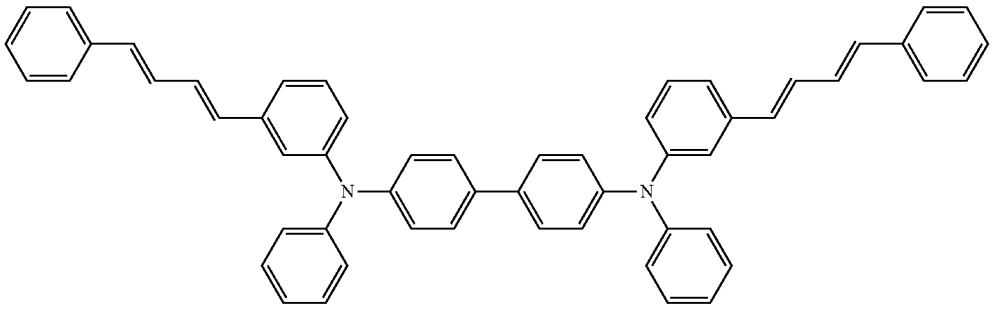

-continued (CTM-3)

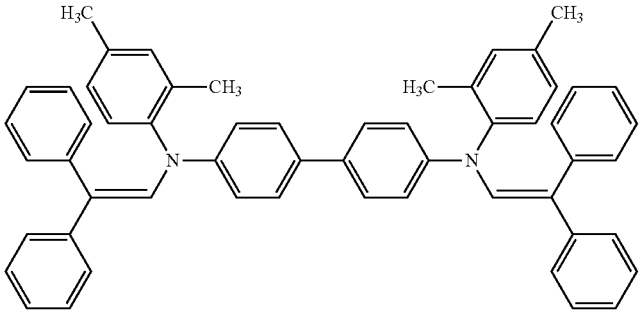

(CTM-4)

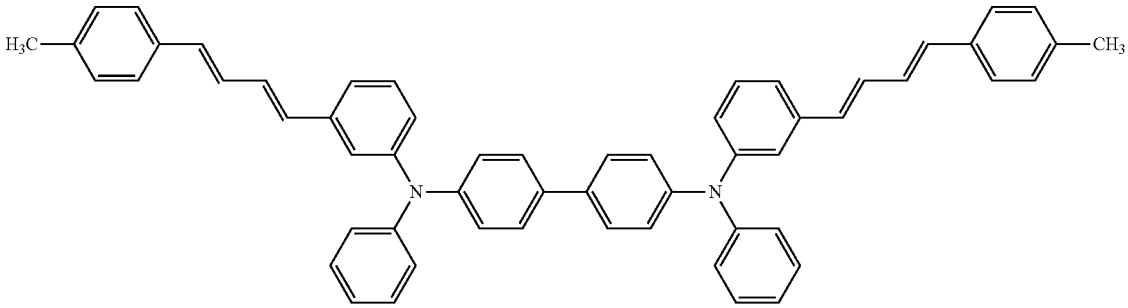

(CTM-5)

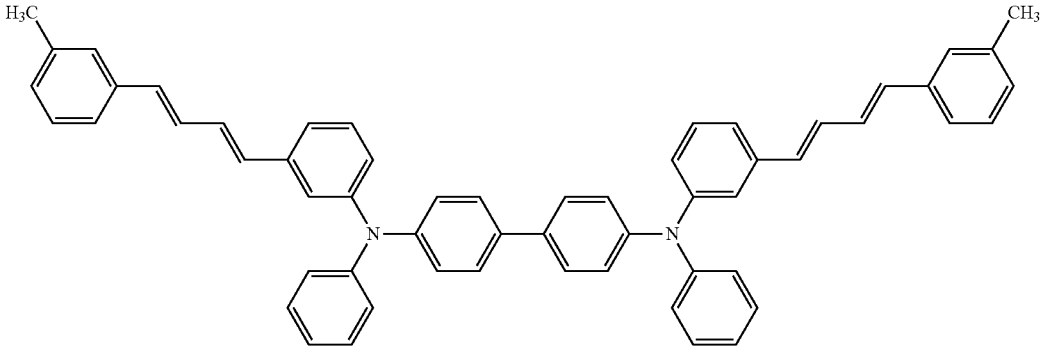

(CTM-6)

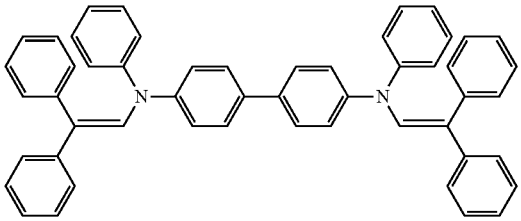

(CTM-7)

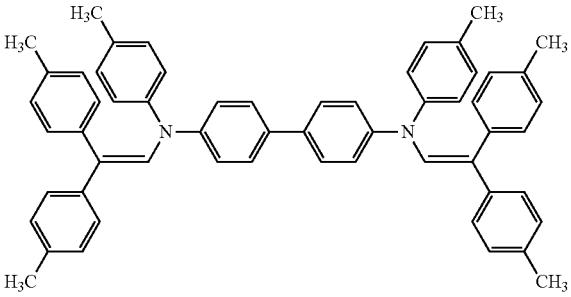

The solubility is measured as follows. First, 1 g of the charge transporting substance is added to 100 g of a solvent in an environment at 23° C. under 1 atmosphere and stirred, and whether the charge transporting substance is dissolved in the solvent is visually determined. The operation is repeated to determine the upper limit of the amount of the charge transporting substance dissolved in 100 g of the solvent, and the mass of the charge transporting substance at the time was defined as the solubility. Solubility X and solubility Y of CTM-1 described above are shown in Table 1 below. Herein, also with respect to other CTMs 2 to 7, solubility X and solubility Y are obtained in the same manner and the (γ) and (δ) are selected so as to satisfy X>Y.

TABLE 1

| Solubility of CTM-1 in 100 g of (γ) or (δ) | |
|---|---|
| Type of (γ) | Solubility X (g) |
| o-Xylene | 20 |
| Toluene | 25 |

TABLE 1-continued

| Solubility of CTM-1 in 100 g of (γ) or (δ) | |
|---|---|
| Type of (δ) | Solubility Y (g) |
| Cyclohexanone | 16 |
| Diethylene glycol diethyl ether | 4 |
| 1-Hexanol | 6 |
| 1-Heptanol | 6 |
| Cyclohexanol | 8 |
| Benzyl alcohol | 6 |
| Ethylene glycol | 6 |
| 1,4-Butanediol | 8 |
| 1,5-Pentanediol | 6 |
| Diethylene glycol | 4 |
| Diethylene glycol ethyl methyl ether | 4 |
| Ethylene carbonate | 12 |
| Propylene carbonate | 12 |
| Nitrobenzene | 14 |
| N-Methylpyrrolidone | 14 |
| Methyl benzoate | 12 |
| Ethyl benzoate | 12 |
| Benzyl acetate | 16 |
| Ethyl 3-ethoxypropionate | 10 |
| Acetophenone | 12 |
| Methyl salicylate | 8 |
| Dimethyl phthalate | 16 |
| Sulfolane | 14 |

(Regarding (β))

The (β) is at least one selected from the group consisting of a polycarbonate resin having a structural unit represented by the following formula (1A), and a polyester resin having a structural unit represented by the following formula (1B). The (β) is, for example, a binder resin.

(1A)

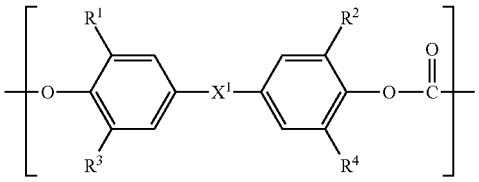

(1B)

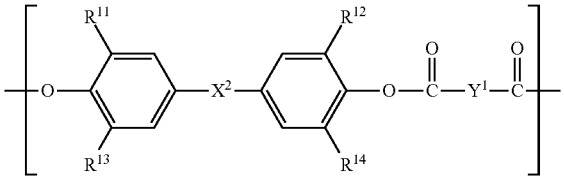

In the formula (1A), $R^1$ to $R^4$ each independently represent a hydrogen atom, a methyl group or a phenyl group, and $X^1$ represents a single bond, an oxygen atom, a cyclohexylidene group or a bivalent group represented by the following formula (A).

In the formula (1B), $R^{11}$ to $R^{14}$ each independently represent a hydrogen atom, a methyl group or a phenyl group, $X^2$ represents a single bond, an oxygen atom, a cyclohexylidene group or a bivalent group represented by the following formula (A), and $Y^1$ represents a meta-phenylene group, a para-phenylene group, a cyclohexylene group or a bivalent group represented by the following formula (B).

(A)

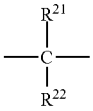

(B)

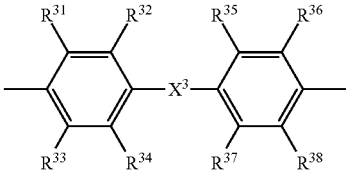

In the formula (A), $R^{21}$ and $R^{22}$ each independently represent a hydrogen atom, a methyl group, an ethyl group or a phenyl group.

In the formula (B), $R^{31}$ to $R^{38}$ each independently represent a hydrogen atom, a methyl group or a phenyl group, and $X^3$ represents a single bond, an oxygen atom, a sulfur atom or a methylene group.

Specific examples of the structural unit of the polycarbonate resin having the structural unit represented by the formula (1A) are shown below.

(1-1)

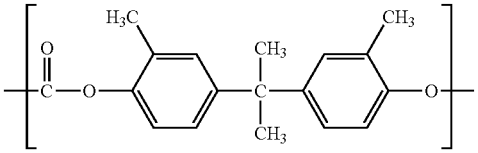

(1-2)

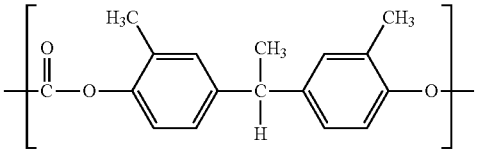

(1-3)

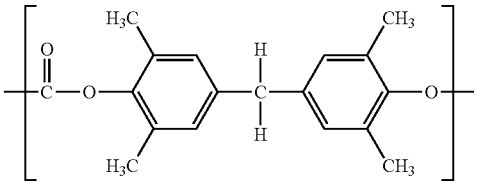

(1-4)

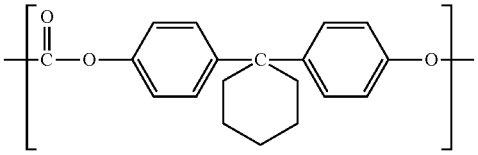

(1-5)

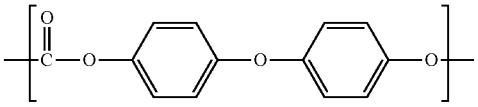

-continued (1-6)

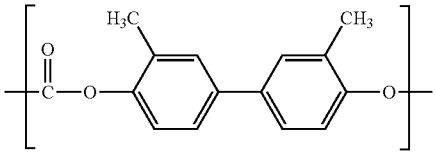

(1-7)

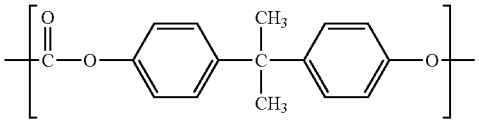

(1-8)

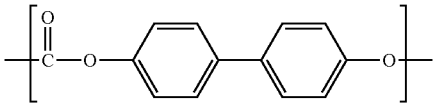

-continued (1-9)

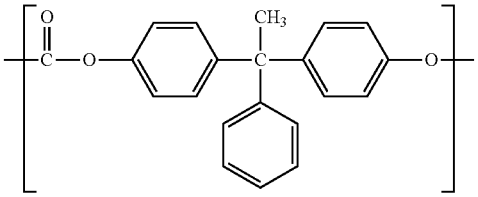

In particular, the structural unit can be a structural unit represented by any of the formulae (1-1), (1-2), (1-4) and (1-5). In addition, one of the structural units can be used singly, or two or more of the structural units can be used as a mixture or a copolymer. The copolymerization form may be any of block copolymerization, random copolymerization and alternating copolymerization.

Specific examples of the structural unit of the polyester resin having the structural unit represented by the formula (1B) are shown below.

(1-10)

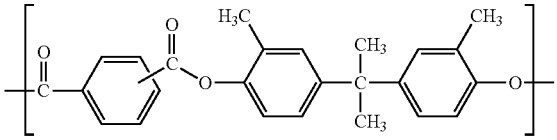

(1-11)

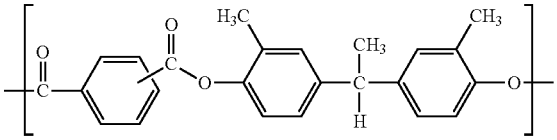

(1-12)

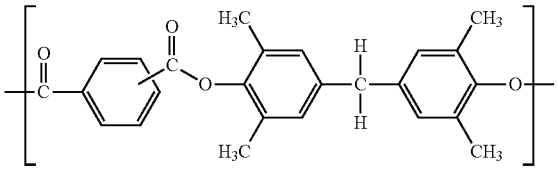

(1-13)

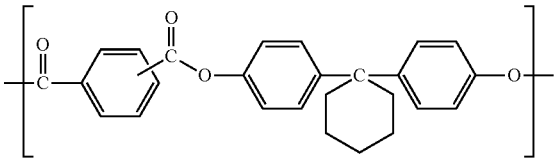

(1-14)

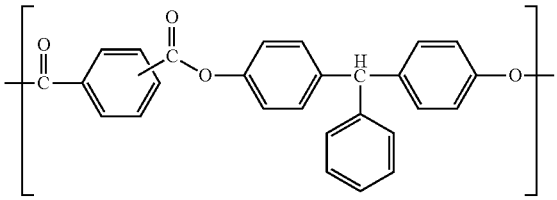

(1-15)

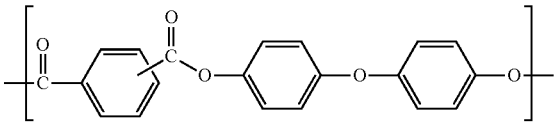

(1-16)

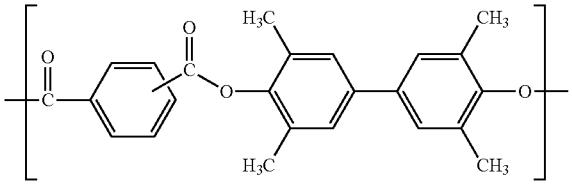

(1-17)

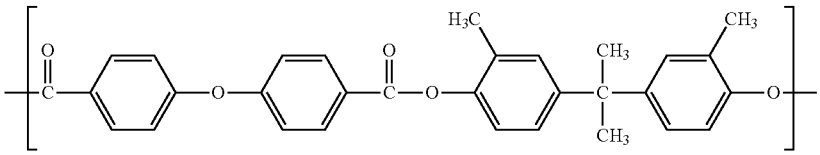

-continued (1-18)

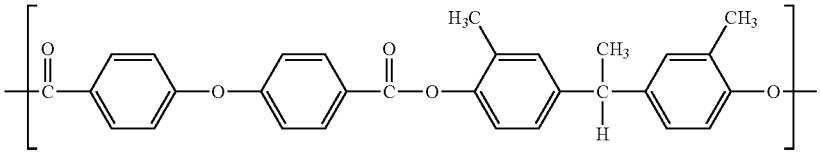

(1-19)

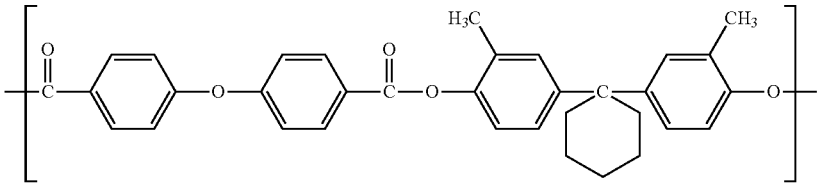

(1-20)

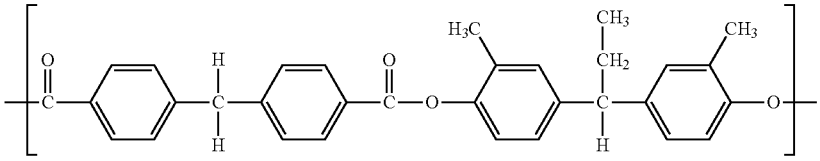

(1-21)

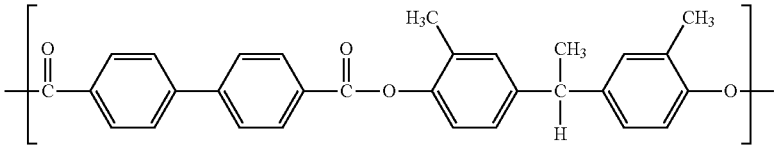

(1-22)

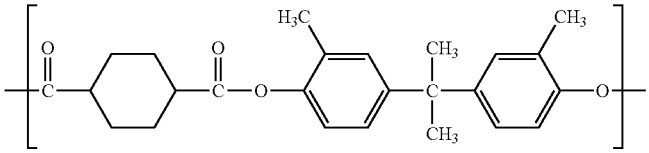

In particular, the structural unit can be a structural unit represented by any of the formulae (1-10), (1-11), (1-12), (1-15), (1-16), (1-17) and (1-18). In addition, one of the structural units can be used singly, or two or more of the structural units can be used as a mixture or a copolymer. The copolymerization form may be any of block copolymerization, random copolymerization and alternating copolymerization.

The polycarbonate resin having the structural unit represented by the formula (1A) and the polyester resin having the structural unit represented by the formula (1B) can be synthesized by a known method. The polycarbonate resin can be synthesized by a phosgene method or a transesterification method. The polyester resin can be synthesized by, for example, the method described in Japanese Patent Application Laid-Open No. 2007-047655 or Japanese Patent Application Laid-Open No. 2007-72277. The weight average molecular weights of the polycarbonate resin and the polyester resin are preferably 20,000 or more and 300,000 or less, and more preferably 50,000 or more and 200,000 or less.

In the present invention, the weight average molecular weight of the resin is a weight average molecular weight in terms of polystyrene measured according to an ordinary method, the method described in Japanese Patent Application Laid-Open No. 2007-79555.

Furthermore, the charge-transporting-layer coating liquid is free of any polyester resins having a siloxane structure at the end thereof and any polycarbonate resins having a siloxane structure at the end thereof. The siloxane structure is a structure having silicon atoms constituting a siloxane moiety at each of both ends and groups connected thereto, as well as an oxygen atom, a silicon atom and groups connected thereto sandwiched between the silicon atoms at each of both ends. Specifically, the siloxane structure means a structure in a frame of a dashed line indicated in the following formula (D-S). In the formula (D-S), symbol a denotes the number of repetitions of the structure in brackets, and the average value of symbol a in the resin is 1 or more and 500 or less.

(D-S)

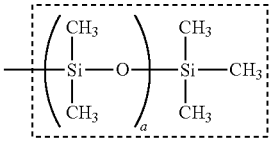

The charge-transporting-layer coating liquid may contain other solvent in addition to the (α), (β), (γ) and (δ). As other solvent, (ϵ) a compound having a boiling point under 1 atmosphere of 35 to 70° C. can be contained. It is considered that by containing the (ϵ) having a lower boiling point as described above, the solvent preferentially vaporizes at the initial stage of drying of the coat of the charge-transporting-layer coating liquid and heat exchange (endotherm) occurs in the vicinity of the surface of the charge transporting layer to increase the mass proportion of the binder resin. The (6) described above can be acetone (boiling point: 56.5° C.), diethyl ether (boiling point: 35° C.), methyl acetate (boiling point: 56.9° C.), tetrahydrofuran (boiling point: 66° C.) or dimethoxymethane (boiling point: 42° C.)

The total content of the (γ) and (δ) based on the total content of the (γ), (δ) and (6) in the charge-transporting-layer coating liquid can be 50% by mass or more and 90% by mass or less in terms of the effects of the present invention.

Then, the configuration of the electrophotographic photosensitive member produced by the production method of the present invention is described.

Figure 2A:
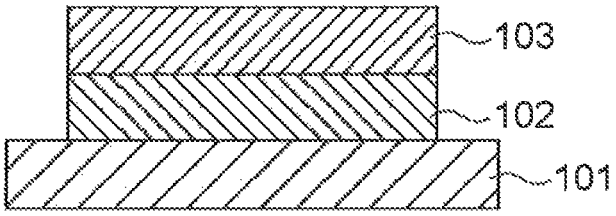
FIG. 2A and FIG. 2B are views illustrating one example of a layer configuration of an electrophotographic photosensitive member.
Figure 2B:
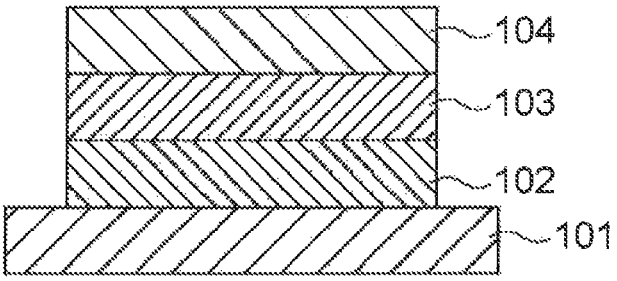

The electrophotographic photosensitive member produced by the production method of the present invention has a support, a charge generating layer formed on the support and a charge transporting layer formed on the charge generating layer. FIG. 2A and FIG. 2B are views illustrating one example of a layer configuration of the electrophotographic photosensitive member of the present invention. In FIG. 2A and FIG. 2B, reference number 101 represents a support, reference number 102 represents a charge generating layer, reference number 103 represents a charge transporting layer, and reference number 104 represents a protective layer (second charge transporting layer).

(Support)

The support can be one having conductivity (conductive support). For example, a support made of a metal such as aluminum, aluminum alloy or stainless can be used. When the support is a support made of aluminum or an aluminum alloy, an ED tube, an EI tube, or a support obtained by subjecting the ED tube or the EI tube to cutting, electrolytic composite polishing (electrolysis by an electrode having an electrolysis function and an electrolyte solution, and polishing by a grinding stone having a polishing function), or wet or dry honing treatment can also be used. A metal support having a layer on which a covering film is formed by vapor deposition of aluminum, an aluminum alloy or an indium oxide-tin oxide alloy, or a resin support can also be used.

A support in which conductive particles such as carbon black, tin oxide particles, titanium oxide particles or silver particles are impregnated with a resin, or a plastic having a conductive binder resin can also be used.

The surface of the support may be subjected to cutting treatment, roughening treatment or alumite treatment in order to suppress an interference pattern due to scattering of laser light or the like.

When the surface of the support is a layer provided in order to impart conductivity, the volume resistivity of the layer is preferably $1\times10^{10}$ Ω·cm or less and particularly preferably $1\times10^{6}$ Ω·cm or less.

In the electrophotographic photosensitive member, a conductive layer may be provided on the support in order to suppress an interference pattern due to scattering of laser light or the like and cover scratch on the support. The conductive layer is a layer formed by drying a coat of a conductive-layer coating liquid in which the conductive particles are dispersed in the binder resin.

Examples of the conductive particles include carbon black, acetylene black, powders of metals such as aluminum, nickel, iron, Nichrome, copper, zinc and silver, and powders of metal oxides such as conductive tin oxide and ITO.

Examples of the binder resin include a polyester resin, a polycarbonate resin, a polyvinyl butyral resin, an acrylic resin, a silicone resin, an epoxy resin, a melamine resin, a urethane resin, phenolic resin and an alkyd resin.

Examples of the solvent of the conductive-layer coating liquid include an ether-based solvent, an alcohol-based solvent, a ketone-based solvent and an aromatic hydrocarbon solvent.

The thickness of the conductive layer is preferably 0.2 μm or more and 40 μm or less, more preferably 1 μm or more and 35 μm or less, and further preferably 5 μm or more and 30 μm or less.

An undercoat layer may be provided between the support or the conductive layer and the charge generating layer. The undercoat layer can be formed by applying a coat of an undercoat-layer coating liquid containing a binder resin on the support or the conductive layer, and drying or curing the coat.

Examples of the binder resin of the undercoat layer include polyacrylic acids, methylcellulose, ethylcellulose, a polyamide resin, a polyimide resin, a polyamide-imide resin, a polyamide acid resin, a melamine resin, an epoxy resin and a polyurethane resin. The binder resin for use in the undercoat layer can be a thermoplastic resin. Specifically, the binder resin can be a thermoplastic polyamide resin. The polyamide resin can be low crystalline or non-crystalline copolymerized nylon that can be applied in the state of solution.

The thickness of the undercoat layer is preferably 0.05 μm or more and 40 μm or less, more preferably 0.05 μm or more and 7 μm or less, and further preferably 0.1 μm or more and 2 μm or less.

In addition, in order that the flow of charge (carrier) is not disrupted in the undercoat layer, the undercoat layer may contain semiconductive particles or an electron transporting substance (electron-accepting substance such as acceptor).

(Charge Generating Layer)

The charge generating layer is formed on the support, the conductive layer or the undercoat layer.

Examples of the charge generating substance for use in the electrophotographic photosensitive member include an azo pigment, a phthalocyanine pigment, an indigo pigment and a perylene pigment. The charge generating substance for use in the present invention may be made of only one compound (pigment), or may be made of two or more compounds (pigments). The compound (pigment) that is preferably used as the charge generating substance is oxytitamium phthalocyanine, hydroxygallium phthalocyanine or chlorogallium phthalocyanine from the viewpoint of a high sensitivity, and the compound that is more preferably used is hydroxygallium phthalocyanine.

Examples of the binder resin for use in the charge generating layer include a polycarbonate resin, a polyester resin, a butyral resin, a polyvinyl acetal resin, an acrylic resin, a vinyl acetate resin and a urea resin. In particular, the binder resin can be a butyral resin. One of the resins can be used singly, or two or more of the resins can be used as a mixture or a copolymer.

The charge generating layer can be formed by forming a coat of a charge-generating-layer coating liquid obtained by dispersing the charge generating substance together with the binder resin and the solvent, and drying the coat. In addition, the charge generating layer may be a vapor deposition film of the charge generating substance.

Examples of the dispersing method include methods using a homogenizer, ultrasonic wave, a ball mill, a sand mill, Attritor or a roll mill.

The ratio of the charge generating substance to the binder resin is preferably in a range from 1:10 to 10:1 (mass ratio) and particularly preferably in a range from 1:1 to 3:1 (mass ratio).

Examples of the solvent for use in the charge-generating-layer coating liquid include an alcohol-based solvent, a sulfoxide-based solvent, a ketone-based solvent, an ether-based solvent, an ester-based solvent or an aromatic hydrocarbon solvent.

The thickness of the charge generating layer is preferably 5 μm or less and more preferably 0.1 μm or more and 2 μm or less.

In addition, various photosensitizers, antioxidants, ultraviolet absorbers, plasticizers and the like can be added to the charge generating layer, if necessary. In addition, in order that the flow of charge (carrier) is not disrupted in the charge generating layer, the charge generating layer may contain an electron transporting substance (electron-accepting substance such as acceptor).

(Charge Transporting Layer)

The charge transporting layer is provided on the charge generating layer.

The charge transporting layer can be formed by forming a coat of a charge-transporting-layer coating liquid containing the (α), (β), (γ) and (δ), and drying the coat. The (α), (β), (γ) and (δ) are as described above.

The ratio of the charge transporting substance to the binder resin is preferably in a range from 3:10 to 20:10 (mass ratio) and more preferably in a range from 5:10 to 15:10 (mass ratio).

The thickness of the charge transporting layer is preferably 5 μm or more and 50 μm or less and more preferably 10 μm or more and 35 μm or less.

Various additives can be added to the respective layers of the electrophotographic photosensitive member. Examples of the additive include antidegradants such as an antioxidant, an ultraviolet absorber and a light stabilizer, and fine particles such as organic fine particles and inorganic fine particles. Examples of the antidegradant include a hindered phenol-based antioxidant, a hindered amine-based light stabilizer, a sulfur atom-containing antioxidant and a phosphorus atom-containing antioxidant. Examples of the organic fine particles include polymer resin particles such as fluorine atom-containing resin particles, polystyrene fine particles and polyethylene resin particles. Examples of the inorganic fine particles include metal oxides such as silica and alumina.

When the coating liquid for each of the layers is applied, an applying method such as a dip-applying method (dip coating method), a spray coating method, a spinner coating method, a roller coating method, a Meyer bar coating method or a blade coating method can be used. In particular, a dip-applying method can be used.

The drying temperature for each of the layers can be 60° C. or higher and 150° C. or lower. The drying temperature for the charge transporting layer can be particularly 100° C. or higher and 140° C. or lower. In addition, the drying time is preferably 10 to 60 minutes and more preferably 20 to 60 minutes.

(Electrophotographic Apparatus)

FIG. 1 illustrates one example of a schematic configuration of an electrophotographic apparatus equipped with a process cartridge having the electrophotographic photosensitive member of the present invention. In FIG. 1, reference number 1 represents a cylindrical electrophotographic photosensitive member, and the cylindrical electrophotographic photosensitive member is rotation-driven around an axis 2 in an arrow direction at a predetermined circumferential velocity. The surface of the electrophotographic photosensitive member 1 rotation-driven is uniformly charged to a predetermined positive or negative potential by a charging unit (primary charging unit: charging roller or the like) 3. Then, the surface is subjected to exposure light (image exposure light) 4 intensity-modulated according to a time-series electric digital image signal of intended image information that is output from an exposure unit (not illustrated) for slit exposure, laser beam scanning exposure or the like. Thus, an electrostatic latent image according to an intended image is sequentially formed on the surface of the electrophotographic photosensitive member 1.

The electrostatic latent image formed on the surface of the electrophotographic photosensitive member 1 is developed by reversal development with toner contained in a developer of a developing unit 5, to form a toner image. Then, the toner image formed and carried on the surface of the electrophotographic photosensitive member 1 is sequentially transferred to a transfer material (paper or the like) P by transfer bias from a transfer unit (transfer roller or the like) 6. Herein, the transfer material P is taken out of a transfer material-feeding unit (not illustrated) to a portion between the electrophotographic photosensitive member 1 and the transfer unit 6 (contact portion) in synchronization with the rotation of the electrophotographic photosensitive member 1, and fed. In addition, a bias voltage having a polarity opposite to the charge of the toner is applied from a bias power source (not illustrated) to the transfer unit 6.

The transfer material P to which the toner image is transferred is separated from the surface of the electrophotographic photosensitive member 1, introduced to a fixing unit 8 to be subjected to a treatment for fixing the toner image, and thus printed out as an image formed product (print, copy) to the outside of the apparatus.

The surface of the electrophotographic photosensitive member 1 to which the toner image has been transferred is subjected to the removal of the developer as a transfer residue (transfer residual toner) by a cleaning unit (cleaning blade or the like) 7, and cleaned. Then, the surface is subjected to a discharging treatment by pre-exposure light (not illustrated) from a pre-exposure unit (not illustrated), and then repeatedly used for image formation. When the charging unit 3 is a contact charging unit using a charging roller or the like as illustrated in FIG. 1, pre-exposure is not necessarily needed.

A plurality of components from the components such as the electrophotographic photosensitive member 1, the charging unit 3, the developing unit 5, the transfer unit 6 and the cleaning unit 7 may be selected and configured so as to be accommodated in a container and integrally supported as a process cartridge. Then, the process cartridge may be configured so as to be detachable to the main body of the electrophotographic apparatus such as a copier and a laser beam printer. In FIG. 1, the electrophotographic photosensitive member 1 is integrally supported together with the charging unit 3, the developing unit 5 and the cleaning unit 7 to provide a cartridge, and the cartridge is used as a process cartridge 9 that is detachable to the main body of the electrophotographic apparatus by using a guiding unit 10 such as a rail of the main body of the electrophotographic apparatus.

EXAMPLES

Hereinafter, the present invention will be described with reference to specific Examples in more detail. However, the present invention is not limited to the Examples. Herein, "parts" in Examples means "parts by mass".

Example 1

An aluminum cylinder having a diameter of 24 mm and a length of 261.6 mm was used as a support (conductive support).

Then, 10 parts of barium sulfate coated with $SnO_2$ (conductive particles), 2 parts of titanium oxide (pigment for regulating resistance), 6 parts of a phenolic resin (binder resin), 0.001 parts of a silicone oil (leveling agent) and a mixed solvent of 4 parts of methanol and 16 parts of methoxy propanol were used to prepare a conductive-layer coating liquid. The conductive-layer coating liquid was dip-applied on the support to form a coat, and the resulting coat was cured (thermally cured) at 140° C. for 30 minutes to thereby form a conductive layer having a thickness of 25 μm.

Then, 3 parts of N-methoxymethylated nylon and 3 parts of copolymerized nylon were dissolved in a mixed solvent of 65 parts of methanol and 30 parts of n-butanol to thereby prepare an undercoat-layer coating liquid. The undercoat-layer coating liquid was dip-applied on the conductive layer to form a coat, and the resulting coat was dried at 100° C. for 10 minutes to thereby form an undercoat layer having a thickness of 0.7 μm.

Then, 10 parts of hydroxygallium phthalocyanine crystals (charge generating substance) of a crystal form having strong peaks at Bragg angles 2θ±0.2° of 7.5°, 9.9°, 16.3°, 18.6°, 25.1° and 28.3° in CuKα characteristic X-ray diffraction were added to a liquid in which 5 parts of a polyvinyl butyral resin (product name: S-Lec BX-1 produced by Sekisui Chemical Co., Ltd.) was dissolved in 250 parts of cyclohexanone, and was dispersed by a sand mill apparatus using glass beads having a diameter of 1 mm in an atmosphere at 23±3° C. for 1 hour. After the dispersing, 250 parts of ethyl acetate was added thereto to thereby prepare a charge-generating-layer coating liquid. The charge-generating-layer coating liquid was dip-applied on the undercoat layer to form a coat, and the resulting coat was dried at 100° C. for 10 minutes to thereby form a charge generating layer having a thickness of 0.22 μm.

Then, (α) 9 parts of the compound represented by the formula (CTM-1) as a charge transporting substance, and (β) 13 parts of polycarbonate resin A (weight average molecular weight 55000) having the structural unit represented by the formula (1-4) were dissolved in a mixed solvent of (γ) 80 parts of o-xylene (boiling point: 144° C.) and (δ) 20 parts of cyclohexanone (boiling point: 155.6° C.) to thereby prepare a charge-transporting-layer coating liquid. The charge-transporting-layer coating liquid was dip-applied on the charge generating layer, and the resulting coat was dried at 130° C. for 60 minutes to thereby form a charge transporting layer (surface layer) having a thickness of 20 μm. Herein, the polycarbonate resin A was free of a siloxane structure at the end thereof.

Herein, solubility X of CTM-1 in 100 g of o-xylene was 20 g and solubility Y of CTM-1 in 100 g of cyclohexanone was 16 g, thereby satisfying a relationship of X>Y.

Thus, an electrophotographic photosensitive member having the support, the conductive layer, the undercoat layer, the charge generating layer and the charge transporting layer in this order, the charge transporting layer being a surface layer, was produced.

(Measurement of Concentration Gradient of Charge Transporting Substance in Charge Transporting Layer)

The electrophotographic photosensitive member produced as described above was obliquely cut in the thickness direction by an ultramicrotome, and the resulting oblique plane was subjected to IR spectroscopy (IR) measurement by the μATR method. FT-IR manufactured by PerkinElmer Co., Ltd. was used for measuring an IR spectrum, the ATR crystal was Ge, the measurement pitch was about 80 μm, and the number of accumulations performed was 256. The absorption bands shown below, suitable for the types of the charge transporting substance and the resin used in the charge transporting layer, were selected from the resulting spectrum, and the change in the mass ratio of the charge transporting substance to the resin was observed from the intensity ratio of the bands. With respect to the quantitative determination method, the calibration curve method by a known standard sample was used. The results are shown in Table 4.

(CTM1) 1590 $cm^{-1}$ (CTM2) 1486 $cm^{-1}$ (CTM3) 1491 $cm^{-1}$ (CTM4) 1488 $cm^{-1}$ (CTM6) 1493 $cm^{-1}$

Polyester resin A having a structural unit represented by formula (1-4) 1775 $cm^{-1}$ Polyester resin A having a structural unit represented by formula (1-10) 1738 $cm^{-1}$ Polyester resin A having a structural unit represented by formula (1-18) 1734 $cm^{-1}$ Then, the evaluation of the electrophotographic photosensitive member produced is described.

As the evaluation apparatus, color laser jet 4700 altered (40 sheets/min), manufactured by Hewlett-Packard Company, was used. The evaluation was performed in an environment at a temperature of 15° C. and a humidity of 10% RH. The surface potential (dark portion potential and light portion potential) of the electrophotographic photosensitive member was measured at the position of a developing device while the developing device was exchanged with a tool secured so that a probe for potential measurement was located at a position away from the end portion of the electrophotographic photosensitive member by 130 mm. The dark portion potential (VD) of the unexposed part of the electrophotographic photosensitive member was set to −550V, and by irradiating with laser light, the light portion potential (VL1) after light attenuation from the dark portion potential (VD) was measured. In addition, A4 size plain paper was used and 5000 sheets of images were continuously output, and the light portion potential (VL2) was again measured to evaluate the variation in the light portion potential (ΔVL=|VL1−VL2|) before and after 5000 sheets of images were output.

In addition, A4 size plain paper was used and 5000 sheets of images were output in an intermittent mode in which output was suspended with respect to each output of an image, and thereafter the amount of the charge transporting layer abraded (the amount of the thickness reduced) as compared with the initial surface at the center of the electrophotographic photosensitive member was evaluated. The thickness at the time was measured by a film thickness meter, Fischer MMS Eddy Current Probe EAW 3.3 manufactured by Fischer Instruments K.K. Herein, as the amount of the charge transporting layer abraded, one resulting from converting the amount abraded after 5000 sheets of images were output to the value per 1000 sheets (k) is shown.

The evaluation results are shown in Table 4.

Examples 2 to 8

Each of electrophotographic photosensitive members was produced in the same manner as in Example 1 except that (β) polycarbonate resin A having the structural unit represented by the formula (1-4), (γ) o-xylene and (δ) cyclohexanone in Example 1 were changed as shown in Table 2. The evaluation results are shown in Table 4. Herein, each solubility X(g) and each solubility Y(g) are shown in Table 2.

Examples 9 to 29

Each of electrophotographic photosensitive members was produced in the same manner as in Example 1 except that (δ) cyclohexanone in Example 1 was changed as shown in Table 2. The evaluation results are shown in Table 4. Herein, each solubility Y(g) is shown in Table 2.

Examples 30 to 36

Each of electrophotographic photosensitive members was produced in the same manner as in Example 1 except that in Example 1, (γ) 80 parts of o-xylene was changed to 60 parts of o-xylene and 20 parts of (ϵ) shown in Table 2 was added. The evaluation results are shown in Table 4. Herein, each solubility X(g) and each solubility Y(g) are shown in Table 3.

Example 37

An electrophotographic photosensitive member was produced in the same manner as in Example 1 except that (α) CTM-1 and (β) polycarbonate resin A having the structural unit represented by the formula (1-4) in Example 1 were changed as shown in Table 3. The evaluation results are shown in Table 4. Herein, solubility X(g) and solubility Y(g) are shown in Table 3.

Example 38

An electrophotographic photosensitive member was produced in the same manner as in Example 37 except that in Example 37, 80 parts of o-xylene was changed to 60 parts of o-xylene and 20 parts of tetrahydrofuran was added. Herein, solubility Y(g) is shown in Table 3. The evaluation results are shown in Table 4.

Example 39

An electrophotographic photosensitive member was produced in the same manner as in Example 1 except that 20 parts of cyclohexanone in Example 38 was changed to 20 parts of ethylene carbonate. The evaluation results are shown in Table 4.

Example 40

An electrophotographic photosensitive member was produced in the same manner as in Example 37 except that (α) CTM-1 in Example 37 was changed as shown in Table 3. The evaluation results are shown in Table 4. Herein, each solubility X(g) and each solubility Y(g) are shown in Table 3.

Example 41

An electrophotographic photosensitive member was produced in the same manner as in Example 40 except that in Example 40, 80 parts of o-xylene was changed to 60 parts of o-xylene and 20 parts of tetrahydrofuran was added as (6). The evaluation results are shown in Table 4.

Example 42

An electrophotographic photosensitive member was produced in the same manner as in Example 41 except that (δ) 20 parts of cyclohexanone in Example 41 was changed to 20 parts of ethylene carbonate. The evaluation results are shown in Table 4. Herein, solubility Y(g) is shown in Table 2.

Example 43

An electrophotographic photosensitive member was produced in the same manner as in Example 1 except that in Example 1, 80 parts of o-xylene was changed to 60 parts of o-xylene, and 20 parts of cyclohexanone was changed to 40 parts of cyclohexanone. The evaluation results are shown in Table 4.

Example 44

An electrophotographic photosensitive member was produced in the same manner as in Example 1 except that in Example 1, 80 parts of o-xylene was changed to 40 parts of o-xylene, and 20 parts of cyclohexanone was changed to 60 parts of cyclohexanone. The evaluation results are shown in Table 4.

Example 45

An electrophotographic photosensitive member was produced in the same manner as in Example 1 except that in Example 1, 80 parts of o-xylene was changed to 65 parts of o-xylene, 20 parts of cyclohexanone was changed to 25 parts of cyclohexanone, and 10 parts of tetrahydrofuran was added. The evaluation results are shown in Table 4.

Example 46

An electrophotographic photosensitive member was produced in the same manner as in Example 1 except that in Example 1, 80 parts of o-xylene was changed to 70 parts of o-xylene, 20 parts of cyclohexanone was changed to 25 parts of cyclohexanone, and 5 parts of tetrahydrofuran was added. The evaluation results are shown in Table 4.

Example 47

An electrophotographic photosensitive member was produced in the same manner as in Example 1 except that in Example 1, 80 parts of o-xylene was changed to 35 parts of o-xylene, 20 parts of cyclohexanone was changed to 15 parts of cyclohexanone, and 50 parts of tetrahydrofuran was added. The evaluation results are shown in Table 4.

Example 48

An electrophotographic photosensitive member was produced in the same manner as in Example 1 except that in Example 1, 80 parts of o-xylene was changed to 30 parts of o-xylene, 20 parts of cyclohexanone was changed to 10 parts of cyclohexanone, and 60 parts of tetrahydrofuran was added. The evaluation results are shown in Table 4.

Examples 49 to 50

Each of electrophotographic photosensitive members was produced in the same manner as in Example 1 except that (α) CTM-1 and (β) polycarbonate resin A having the structural unit represented by the formula (1-4) in Example 1 were changed as shown in Table 3. The evaluation results are shown in Table 4. Herein, each solubility X(g) and each solubility Y(g) are shown in Table 3.

Examples 51 to 52

Each of electrophotographic photosensitive members was produced in the same manner as in Example 1 except that (γ) o-xylene and (δ) cyclohexanone in Example 1 were changed as shown in Table 3. The evaluation results are shown in Table 4. Herein, each solubility X(g) and each solubility Y(g) are shown in Table 3.

TABLE 2

| Example | (α) | (β) | (γ) | (δ) | (ε) | Solubility X | Solubility Y |
|---|---|---|---|---|---|---|---|
| 1 | CTM-1 | (1-4) | o-Xylene | Cyclohexanone | — | 20 | 16 |
| 2 | CTM-1 | (1-4) | o-Xylene | Diethylene glycol diethyl ether | — | 20 | 4 |
| 3 | CTM-1 | (1-4) | Toluene | Cyclohexanone | — | 25 | 16 |
| 4 | CTM-1 | (1-4) | Toluene | Diethylene glycol diethyl ether | — | 25 | 4 |
| 5 | CTM-1 | (1-10) | o-Xylene | Cyclohexanone | — | 20 | 16 |
| 6 | CTM-1 | (1-10) | o-Xylene | Diethylene glycol diethyl ether | — | 20 | 4 |
| 7 | CTM-1 | (1-10) | Toluene | Cyclohexanone | — | 25 | 16 |
| 8 | CTM-1 | (1-10) | Toluene | Diethylene glycol diethyl ether | — | 25 | 4 |
| 9 | CTM-1 | (1-4) | o-Xylene | 1-Hexanol | — | 20 | 6 |
| 10 | CTM-1 | (1-4) | o-Xylene | 1-Heptanol | — | 20 | 6 |
| 11 | CTM-1 | (1-4) | o-Xylene | Cyclohexanol | — | 20 | 8 |
| 12 | CTM-1 | (1-4) | o-Xylene | Benzyl alcohol | — | 20 | 6 |
| 13 | CTM-1 | (1-4) | o-Xylene | Ethylene glycol | — | 20 | 6 |
| 14 | CTM-1 | (1-4) | o-Xylene | 1,4-Butanediol | — | 20 | 8 |
| 15 | CTM-1 | (1-4) | o-Xylene | 1,5-Pentanediol | — | 20 | 6 |
| 16 | CTM-1 | (1-4) | o-Xylene | Diethylene glycol | — | 20 | 4 |
| 17 | CTM-1 | (1-4) | o-Xylene | Diethylene glycol ethyl methyl ether | — | 20 | 4 |
| 18 | CTM-1 | (1-4) | o-Xylene | Ethylene carbonate | — | 20 | 12 |
| 19 | CTM-1 | (1-4) | o-Xylene | Propylene carbonate | — | 20 | 12 |
| 20 | CTM-1 | (1-4) | o-Xylene | Nitrobenzene | — | 20 | 14 |
| 21 | CTM-1 | (1-4) | o-Xylene | N-Methylpyrrolidone | — | 20 | 14 |
| 22 | CTM-1 | (1-4) | o-Xylene | Methyl benzoate | — | 20 | 12 |
| 23 | CTM-1 | (1-4) | o-Xylene | Ethyl benzoate | — | 20 | 12 |
| 24 | CTM-1 | (1-4) | o-Xylene | Benzyl acetate | — | 20 | 16 |
| 25 | CTM-1 | (1-4) | o-Xylene | Ethyl 3-ethoxypropionate | — | 20 | 10 |
| 26 | CTM-1 | (1-4) | o-Xylene | Acetophenone | — | 20 | 12 |
| 27 | CTM-1 | (1-4) | o-Xylene | Methyl salicylate | — | 20 | 8 |
| 28 | CTM-1 | (1-4) | o-Xylene | Dimethyl phthalate | — | 20 | 16 |
| 29 | CTM-1 | (1-4) | o-Xylene | Sulfolane | — | 20 | 14 |

In Table 2, (β) in each of Examples 2 to 29 is a polycarbonate resin that is free of a siloxane structure at the end thereof.

TABLE 3

| Example | (α) | (β) | (γ) | (δ) | (ε) | Solubility X | Solubility Y |
|---|---|---|---|---|---|---|---|
| 30 | CTM-1 | (1-4) | o-Xylene | Cyclohexanone | Chloroform | 20 | 16 |
| 31 | CTM-1 | (1-4) | o-Xylene | Cyclohexanone | Dichloromethane | 20 | 16 |
| 32 | CTM-1 | (1-4) | o-Xylene | Cyclohexanone | Tetrahydrofuran | 20 | 16 |
| 33 | CTM-1 | (1-4) | o-Xylene | Cyclohexanone | Acetone | 20 | 16 |
| 34 | CTM-1 | (1-4) | o-Xylene | Cyclohexanone | Diethyl ether | 20 | 16 |
| 35 | CTM-1 | (1-4) | o-Xylene | Cyclohexanone | Methyl acetate | 20 | 16 |
| 36 | CTM-1 | (1-4) | o-Xylene | Cyclohexanone | Dimethoxymethane | 20 | 16 |
| 37 | CTM-2 | (1-18) | o-Xylene | Cyclohexanone | — | 16 | 12 |
| 38 | CTM-2 | (1-18) | o-Xylene | Cyclohexanone | Tetrahydrofuran | 16 | 12 |
| 39 | CTM-2 | (1-18) | o-Xylene | Ethylene carbonate | Tetrahydrofuran | 16 | 10 |
| 40 | CTM-3 | (1-18) | o-Xylene | Cyclohexanone | — | 20 | 14 |
| 41 | CTM-3 | (1-18) | o-Xylene | Cyclohexanone | Tetrahydrofuran | 20 | 14 |
| 42 | CTM-3 | (1-18) | o-Xylene | Ethylene carbonate | Tetrahydrofuran | 20 | 10 |
| 43 | CTM-1 | (1-4) | o-Xylene | Cyclohexanone | — | 20 | 16 |
| 44 | CTM-1 | (1-4) | o-Xylene | Cyclohexanone | — | 20 | 16 |
| 45 | CTM-1 | (1-4) | o-Xylene | Cyclohexanone | Tetrahydrofuran | 20 | 16 |
| 46 | CTM-1 | (1-4) | o-Xylene | Cyclohexanone | Tetrahydrofuran | 20 | 16 |
| 47 | CTM-1 | (1-4) | o-Xylene | Cyclohexanone | Tetrahydrofuran | 20 | 16 |
| 48 | CTM-1 | (1-4) | o-Xylene | Cyclohexanone | Tetrahydrofuran | 20 | 16 |
| 49 | CTM-4 | (1-18) | o-Xylene | Cyclohexanone | — | 16 | 12 |
| 50 | CTM-6 | (1-18) | o-Xylene | Cyclohexanone | — | 20 | 14 |
| 51 | CTM-1 | (1-4) | Ethylbenzene | Cyclohexanone | — | 20 | 16 |
| 52 | CTM-1 | (1-4) | Mesitylene | Ethylene carbonate | — | 18 | 12 |

In Table 3, (β) in each of Examples 30 to 52 is a polycarbonate resin that is free of a siloxane structure at the end thereof or a polyester resin that is free of a siloxane structure at the end thereof.

TABLE 4

| Example | Ratio of charge transporting subutance/(β) resin (distance from surface in depth direction) 0 μm | 4 μm | 8 μm | 12 μm | 16 μm | 20 μm | Variation in light portion potential (V) | Amount of charge transporting layer abraded (μm/k) |
|---|---|---|---|---|---|---|---|---|
| 1 | 0.60 | 0.65 | 0.68 | 0.73 | 0.76 | 0.80 | 22 | 0.25 |
| 2 | 0.59 | 0.64 | 0.68 | 0.73 | 0.77 | 0.81 | 20 | 0.27 |
| 3 | 0.60 | 0.64 | 0.69 | 0.74 | 0.77 | 0.82 | 23 | 0.25 |
| 4 | 0.61 | 0.64 | 0.69 | 0.72 | 0.77 | 0.81 | 20 | 0.26 |
| 5 | 0.58 | 0.64 | 0.70 | 0.73 | 0.76 | 0.82 | 15 | 0.20 |
| 6 | 0.60 | 0.66 | 0.71 | 0.74 | 0.76 | 0.82 | 17 | 0.22 |
| 7 | 0.59 | 0.65 | 0.70 | 0.74 | 0.76 | 0.81 | 15 | 0.20 |
| 8 | 0.61 | 0.65 | 0.70 | 0.74 | 0.77 | 0.80 | 15 | 0.20 |
| 9 | 0.55 | 0.61 | 0.67 | 0.73 | 0.80 | 0.85 | 15 | 0.22 |
| 10 | 0.56 | 0.62 | 0.67 | 0.73 | 0.79 | 0.85 | 15 | 0.23 |
| 11 | 0.55 | 0.61 | 0.67 | 0.74 | 0.79 | 0.86 | 17 | 0.20 |
| 12 | 0.55 | 0.60 | 0.68 | 0.72 | 0.81 | 0.86 | 15 | 0.23 |
| 13 | 0.54 | 0.60 | 0.68 | 0.72 | 0.81 | 0.84 | 18 | 0.22 |
| 14 | 0.56 | 0.62 | 0.66 | 0.72 | 0.79 | 0.85 | 15 | 0.20 |
| 15 | 0.54 | 0.62 | 0.66 | 0.73 | 0.80 | 0.86 | 17 | 0.21 |
| 16 | 0.56 | 0.61 | 0.67 | 0.74 | 0.80 | 0.84 | 17 | 0.22 |
| 17 | 0.55 | 0.62 | 0.67 | 0.74 | 0.81 | 0.84 | 15 | 0.20 |
| 18 | 0.56 | 0.61 | 0.68 | 0.73 | 0.80 | 0.85 | 15 | 0.20 |
| 19 | 0.54 | 0.60 | 0.66 | 0.74 | 0.79 | 0.86 | 18 | 0.23 |
| 20 | 0.55 | 0.61 | 0.66 | 0.73 | 0.79 | 0.85 | 15 | 0.21 |
| 21 | 0.56 | 0.61 | 0.67 | 0.74 | 0.81 | 0.85 | 18 | 0.20 |
| 22 | 0.56 | 0.62 | 0.67 | 0.72 | 0.80 | 0.86 | 15 | 0.20 |
| 23 | 0.55 | 0.61 | 0.66 | 0.72 | 0.81 | 0.86 | 17 | 0.20 |
| 24 | 0.56 | 0.62 | 0.66 | 0.74 | 0.79 | 0.84 | 17 | 0.23 |
| 25 | 0.56 | 0.61 | 0.68 | 0.74 | 0.81 | 0.85 | 15 | 0.22 |
| 26 | 0.54 | 0.61 | 0.68 | 0.73 | 0.81 | 0.85 | 15 | 0.22 |
| 27 | 0.55 | 0.61 | 0.67 | 0.73 | 0.80 | 0.84 | 17 | 0.23 |
| 28 | 0.54 | 0.62 | 0.67 | 0.72 | 0.80 | 0.86 | 17 | 0.21 |
| 29 | 0.55 | 0.60 | 0.66 | 0.73 | 0.81 | 0.85 | 15 | 0.21 |
| 30 | 0.55 | 0.61 | 0.67 | 0.73 | 0.79 | 0.85 | 15 | 0.20 |
| 31 | 0.54 | 0.60 | 0.67 | 0.74 | 0.80 | 0.85 | 15 | 0.20 |
| 32 | 0.50 | 0.58 | 0.66 | 0.75 | 0.82 | 0.90 | 10 | 0.15 |
| 33 | 0.51 | 0.58 | 0.65 | 0.75 | 0.82 | 0.91 | 10 | 0.17 |
| 34 | 0.51 | 0.57 | 0.66 | 0.75 | 0.82 | 0.90 | 12 | 0.16 |
| 35 | 0.50 | 0.58 | 0.65 | 0.76 | 0.84 | 0.91 | 12 | 0.15 |
| 36 | 0.50 | 0.57 | 0.65 | 0.75 | 0.82 | 0.91 | 10 | 0.15 |
| 37 | 0.50 | 0.57 | 0.66 | 0.74 | 0.83 | 0.91 | 8 | 0.11 |
| 38 | 0.41 | 0.51 | 0.64 | 0.77 | 0.90 | 1.00 | 5 | 0.08 |
| 39 | 0.30 | 0.47 | 0.63 | 0.77 | 0.93 | 1.10 | 5 | 0.07 |
| 40 | 0.50 | 0.58 | 0.65 | 0.75 | 0.82 | 0.90 | 8 | 0.10 |
| 41 | 0.41 | 0.51 | 0.64 | 0.77 | 0.90 | 1.01 | 5 | 0.08 |
| 42 | 0.30 | 0.48 | 0.64 | 0.77 | 0.92 | 1.09 | 5 | 0.07 |
| 43 | 0.60 | 0.63 | 0.68 | 0.74 | 0.77 | 0.81 | 22 | 0.26 |
| 44 | 0.65 | 0.67 | 0.69 | 0.71 | 0.72 | 0.75 | 25 | 0.30 |
| 45 | 0.50 | 0.57 | 0.66 | 0.75 | 0.82 | 0.90 | 10 | 0.15 |
| 46 | 0.54 | 0.60 | 0.68 | 0.72 | 0.81 | 0.84 | 15 | 0.20 |
| 47 | 0.50 | 0.59 | 0.67 | 0.75 | 0.83 | 0.90 | 10 | 0.15 |
| 48 | 0.50 | 0.64 | 0.69 | 0.74 | 0.81 | 0.88 | 10 | 0.20 |
| 49 | 0.51 | 0.58 | 0.67 | 0.74 | 0.83 | 0.91 | 8 | 0.11 |
| 50 | 0.5 | 0.58 | 0.66 | 0.75 | 0.83 | 0.9 | 8 | 0.11 |
| 51 | 0.6 | 0.65 | 0.68 | 0.73 | 0.76 | 0.8 | 30 | 0.32 |
| 52 | 0.59 | 0.64 | 0.69 | 0.74 | 0.77 | 0.81 | 20 | 0.25 |

Comparative Example 1

An electrophotographic photosensitive member was produced in the same manner as in Example 1 except that cyclohexanone in Example 1 was changed to diethylene glycol ethyl ether (boiling point: 121° C.). The evaluation results are shown in Table 5. Herein, solubility (Y) of CTM-1 in 100 g of diethylene glycol ethyl ether was 6 g. Diethylene glycol ethyl ether (boiling point: 121° C.) is one having a lower boiling point than (γ) o-xylene (boiling point: 144° C.) used in Example 1.

Comparative Example 2

An electrophotographic photosensitive member was produced in the same manner as in Example 1 except that cyclohexanone in Example 1 was changed to o-dichlorobenzene (boiling point: 180.5° C.). The evaluation results are shown in Table 5. Herein, solubility Y of CTM-1 in 100 g of o-dichlorobenzene was 30 g and solubility X of CTM-1 in 100 g of o-xylene was 20 g, and thus a relationship of Y>X is satisfied.

Comparative Example 3

An electrophotographic photosensitive member was produced in the same manner as in Example 1 except that in Example 1, the amount of o-xylene was changed to 100 parts and cyclohexanone was not added. The evaluation results are shown in Table 5.

Comparative Example 4

An electrophotographic photosensitive member was produced in the same manner as in Example 1 except that 80 parts of o-xylene in Example 1 was changed to 80 parts of chlorobenzene. The evaluation results are shown in Table 5.

TABLE 5

| Comparative Example | Ratio of charge transporting substance/(β) resin (distance from surface in depth direction) 0 μm | 4 μm | 8 μm | 12 μm | 16 μm | 20 μm | Variation in light portion potential (V) | Amount of charge transporting layer abraded (μm/k) |
|---|---|---|---|---|---|---|---|---|
| 1 | 0.68 | 0.72 | 0.72 | 0.67 | 0.71 | 0.7 | 35 | 0.41 |
| 2 | 0.72 | 0.76 | 0.69 | 0.67 | 0.67 | 0.69 | 35 | 0.43 |
| 3 | 0.72 | 0.7 | 0.68 | 0.71 | 0.71 | 0.7 | 37 | 0.42 |
| 4 | 0.71 | 0.74 | 0.69 | 0.71 | 0.7 | 0.69 | 37 | 0.43 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-013511, filed Jan. 28, 2013, and No. 2014-004382, filed Jan. 14, 2014 which are hereby incorporated by reference herein in their entirety.

What is claimed is:

1. A method for producing an electrophotographic photosensitive member comprising a support, a charge generating layer formed on the support, and a charge transporting layer formed on the charge generating layer, the method comprising:

dissolving (α) and (β) with solvents of (γ) and (δ) to prepare a charge-transporting-layer coating liquid;

the (α) being a charge transporting substance, the (β) being at least one resin selected from the group consisting of a polycarbonate resin having a structural unit represented by the following formula (1A), and a polyester resin having a structural unit represented by the following formula (1B), the (γ) being an aromatic hydrocarbon solvent which is at least one selected from the group consisting of toluene, xylene and mesitylene, and the (δ) being a compound having a boiling point under 1 atmosphere higher than that of the (γ), forming a coat for the charge transporting layer using the charge-transporting-layer coating liquid, and drying the coat to form the charge transporting layer, wherein the charge transporting layer is a surface layer, the charge-transporting-layer coating liquid is free of any polyester resins having a siloxane structure at the end thereof and any polycarbonate resins having a siloxane structure at the end thereof; and the (α), the (γ) and the (δ) satisfy the following expression:

$$X(g)>Y(g)$$

wherein,

X(g) represents the solubility of the (α) in 100 g of the (γ) in an environment at 23° C. under 1 atmosphere, and Y(g) represents the solubility of the (α) in 100 g of the (δ) in an environment at 23° C. under 1 atmosphere;

(1A)

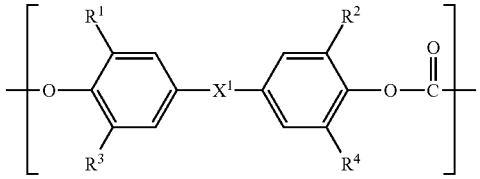

(1B)

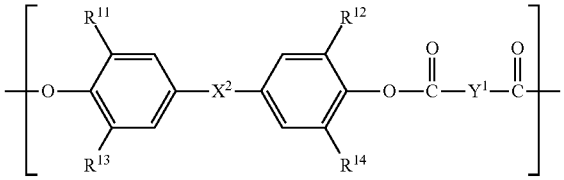

wherein, $R^1$ to $R^4$ each independently represent a hydrogen atom, a methyl group or a phenyl group, $X^1$ represents a single bond, an oxygen atom, a cyclohexylidene group or a bivalent group represented by the following formula (A), $R^{11}$ to $R^{14}$ each independently represent a hydrogen atom, a methyl group or a phenyl group, $X^2$ represents a single bond, an oxygen atom, a cyclohexylidene group or a bivalent group represented by the following formula (A), and $Y^1$ represents a meta-phenylene group, a para-phenylene group, a cyclohexylene group or a bivalent group represented by the following formula (B):

(A)

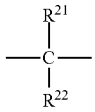

-continued (B)

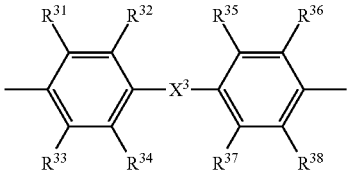

wherein, $R^{21}$ and $R^{22}$ each independently represent a hydrogen atom, a methyl group, an ethyl group or a phenyl group, $R^{31}$ to $R^{38}$ each independently represent a hydrogen atom, a methyl group or a phenyl group, and $X^3$ represents a single bond, an oxygen atom, a sulfur atom or a methylene group, and wherein the content of the (γ) is higher than the content of the (δ) in the charge-transporting-layer coating liquid.

2. The method for producing an electrophotographic photosensitive member according to claim 1, wherein the (δ) is at least one compound selected from the group consisting of hexanol, heptanol, cyclohexanol, benzyl alcohol, ethylene glycol, 1,4-butanediol, 1,5-pentanediol, diethylene glycol, diethylene glycol ethyl methyl ether, ethylene carbonate, propylene carbonate, nitrobenzene, N-methylpyrrolidone, methyl benzoate, ethyl benzoate, benzyl acetate, ethyl-3-ethoxypropionate, acetophenone, methyl salicylate, dimethyl phthalate and sulfolane.

3. The method for producing an electrophotographic photosensitive member according to claim 1, wherein the charge-transporting-layer coating liquid further comprises (ϵ) a compound having a boiling point under 1 atmosphere of 35 to 70° C.

4. The method for producing an electrophotographic photosensitive member according to claim 3, wherein the (ϵ) is at least one compound selected from the group consisting of acetone, diethyl ether, methyl acetate, tetrahydrofuran and dimethoxymethane.

5. The method for producing an electrophotographic photosensitive member according to claim 3, wherein the total content of the (γ) and (δ) based on the total content of the (γ), (δ) and (ϵ) in the charge-transporting-layer coating liquid is 50% by mass or more and 90% by mass or less.

6. The method for producing an electrophotographic photosensitive member according to claim 1, wherein the (α) is at least one selected from the group consisting of a triarylamine compound, a hydrazone compound, a styryl compound, a stilbene compound, a pyrazoline compound, an oxazole compound, a thiazole compound, a triarylmethane compound and an enamine compound.

7. The method for producing an electrophotographic photosensitive member according to claim 6, wherein the (α) is at least one selected from the group consisting of a compound represented by the following formula (2), a compound represented by the following formula (3) and a compound represented by the following formula (4):

(2)

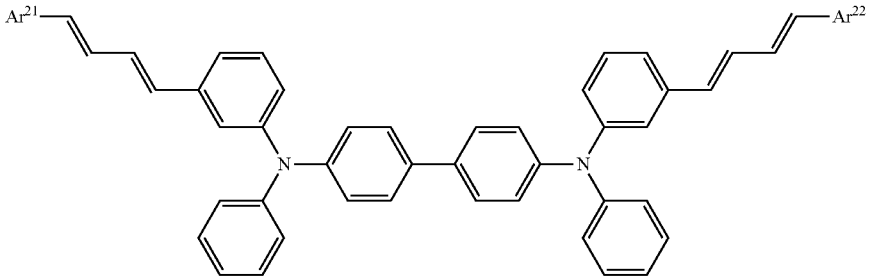

(3)

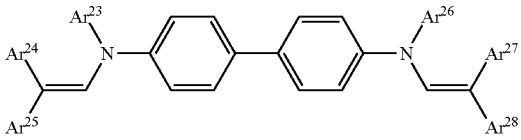

(4)

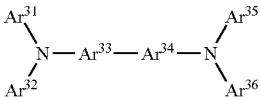

wherein, $Ar^{21}$ and $Ar^{22}$ each independently represent a phenyl group or a phenyl group substituted with a methyl group, $Ar^{23}$ to $Ar^{28}$ each independently represent a phenyl group or a phenyl group substituted with a methyl group, $Ar^{31}$, $Ar^{32}$, $Ar^{35}$ and $Ar^{36}$ each independently represent a phenyl group or a phenyl group substituted with a methyl group, and $Ar^{33}$ and $Ar^{34}$ each independently represent a phenylene group or a phenylene group substituted with a methyl group.

8. The method for producing an electrophotographic photosensitive member according to claim 1, wherein the drying temperature for drying the coat is 100° C. or higher and 140° C. or lower.

* * * * *